US008136253B2

(12) United States Patent
Zoot et al.

(10) Patent No.: US 8,136,253 B2
(45) Date of Patent: Mar. 20, 2012

(54) HAIR COMB ATTACHMENT FOR A HAIR TRIMMER

(75) Inventors: Ivan K. Zoot, Buffalo Grove, IL (US); Christopher J. Braun, Racine, WI (US)

(73) Assignee: Andis Company, Sturtevant, WI (US)

( * ) Notice: Subject to any disclaimer, the term of this patent is extended or adjusted under 35 U.S.C. 154(b) by 286 days.

(21) Appl. No.: 11/670,144

(22) Filed: Feb. 1, 2007

(65) Prior Publication Data

US 2008/0184565 A1 Aug. 7, 2008

(51) Int. Cl.
*B26B 19/00* (2006.01)
*B26B 13/00* (2006.01)

(52) U.S. Cl. ..... 30/233.5; 30/195; 30/200

(58) Field of Classification Search ..... 30/233.5, 30/196, 233, 195, 200–202
See application file for complete search history.

(56) References Cited

U.S. PATENT DOCUMENTS

| | | | | |
|---|---|---|---|---|
| 1,908,385 | A * | 5/1933 | Wahl | 30/195 |
| 2,256,076 | A | 9/1941 | Coles | |
| 2,864,162 | A | 12/1958 | MacDonald | |
| 3,295,202 | A | 1/1967 | Pucino | |
| 4,146,960 | A * | 4/1979 | Flowers et al. | 30/195 |
| 4,571,830 | A | 2/1986 | Kassner et al. | |
| 4,614,036 | A * | 9/1986 | Haraguchi | 30/200 |
| 5,259,114 | A | 11/1993 | Shorter | |
| D364,939 | S | 12/1995 | Scott | |
| 6,079,103 | A * | 6/2000 | Melton et al. | 30/43.92 |
| 6,418,623 | B1 | 7/2002 | Marcarelli | |
| 6,618,948 | B2 | 9/2003 | Lin | |
| 6,807,736 | B2 | 10/2004 | Langley | |
| 7,051,442 | B2 | 5/2006 | McCambridge et al. | |
| 2003/0056374 | A1 | 3/2003 | Langley | |
| 2005/0138817 | A1 * | 6/2005 | Yamaguchi et al. | 30/233 |

* cited by examiner

*Primary Examiner* — Phong Nguyen
(74) *Attorney, Agent, or Firm* — Michael Best & Friedrich LLP

(57) ABSTRACT

A comb attachment for a hair trimmer includes a comb body having a leading edge and a trailing edge, wherein the trailing edge defines an attachment member for attaching the comb body to the hair trimmer. The comb attachment further includes a plurality of tines at the leading edge of the comb body, wherein adjacent tines define a hair guide slot and the hair guide slot includes first and second side walls. The comb attachment also includes a pair of fins associated with the hair guide slot wherein one fin is positioned proximate each side wall of the hair guide slot and each fin extends from the associated tine.

17 Claims, 6 Drawing Sheets

HAIR COMB ATTACHMENT FOR A HAIR TRIMMER

BACKGROUND

This invention relates to comb attachments for hair trimmers, which are removably attachable to a hair trimmer to assist an operator in cutting hair to achieve various styling textures and cuts.

A standard comb attachment is used to control the length of hair being cut, whereby various comb attachments are used to create different hair cut lengths. However, current comb attachments do not enable a hair trimmer operator to create different hair styles and textures based on any criteria other than length. Current comb attachments generally only provide a variety of hair cut lengths and do not allow for applying a variety of textures and styling techniques to hair.

SUMMARY

In one embodiment, the invention provides a comb attachment for a hair trimmer. The comb attachment includes a comb body having a leading edge and a trailing edge, wherein the trailing edge defines an attachment member for attaching the comb body to the hair trimmer. The comb attachment further includes a plurality of tines at the leading edge of the comb body, wherein adjacent tines define a hair guide slot. The hair guide slot includes first and second side walls. The comb attachment also includes a pair of fins associated with the hair guide slot, wherein one fin is positioned proximate each side wall of the hair guide slot and each fin extends from the associated tine.

In another embodiment, the invention provides hair cutting system for cutting hair. The system includes a hair trimmer and a plurality of comb attachments. The plurality of comb attachments are configured to be removably coupled to the hair trimmer. Each comb attachment has a comb body including a leading edge and a trailing edge, wherein the trailing edge defines an attachment member for attaching the comb body to the hair trimmer. The plurality of comb attachments further includes a plurality of tines at the leading edge of the comb body, wherein adjacent tines define a hair guide slot.

In yet another embodiment, the invention provides a comb attachment for a hair trimmer. The comb attachment comprises a comb body including a leading edge and a trailing edge, wherein the trailing edge defines an attachment member for attaching the comb body to the hair trimmer. The comb attachment further includes a plurality of tines at the leading edge of the comb body and a plurality of hair guide slots, each hair guide slot defined by adjacent tines and including first and second side walls. The comb attachment further includes a pair of fins associated with the hair guide slot, wherein one fin is positioned proximate each sidewall of the hair guide slot and each fin extends from the associated tine. The comb attachment also includes a pocket defined by the leading edge of the comb body, wherein the pocket houses a cutting edge of a blade of the hair trimmer.

Other aspects of the invention will become apparent by consideration of the detailed description and accompanying drawings.

Figure 1:
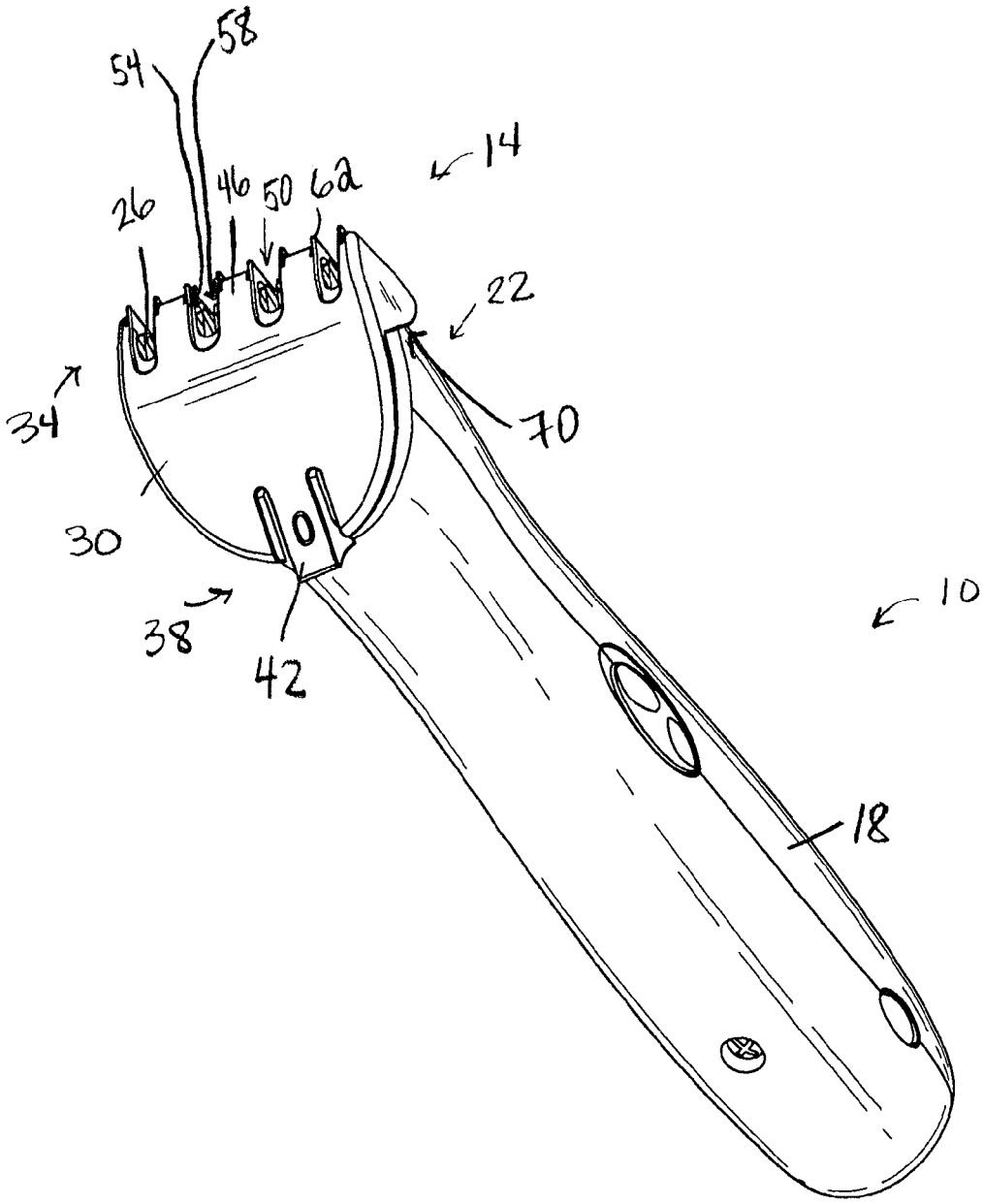
FIG. 1 is a bottom perspective view of a hair trimmer including a comb attachment embodying various features of the invention.
Figure 2:
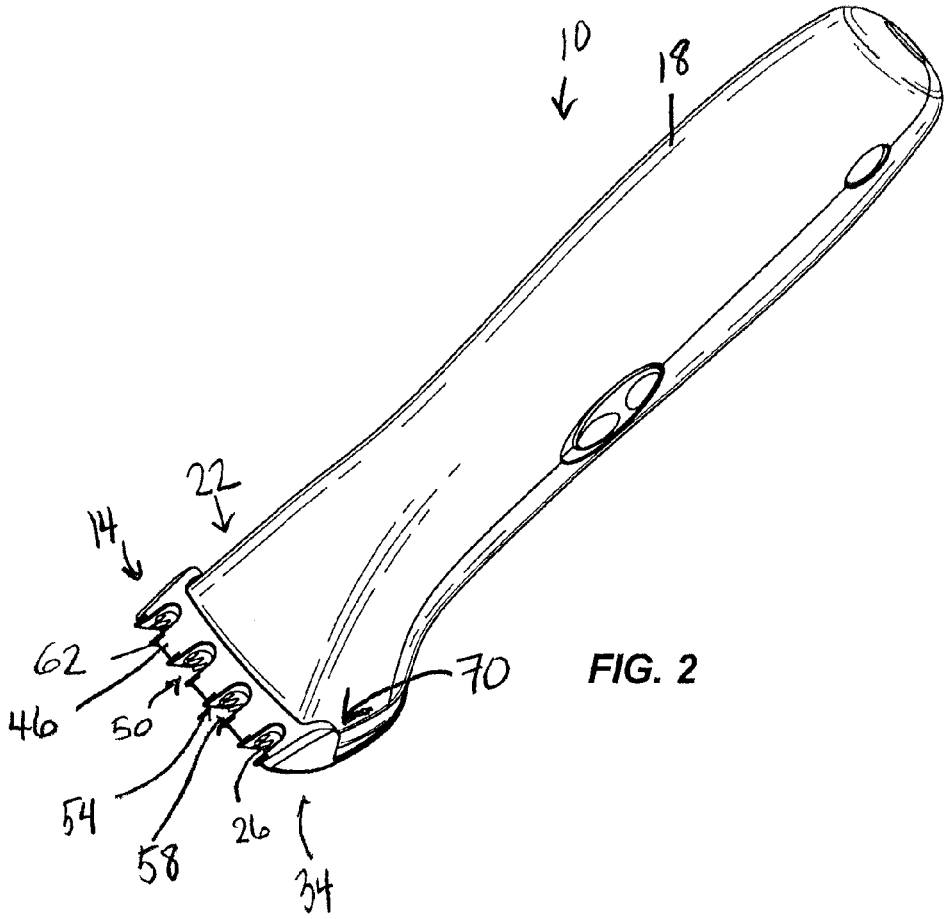
FIG. 2 is a top perspective view of the hair trimmer shown in FIG. 1.
Figure 3:
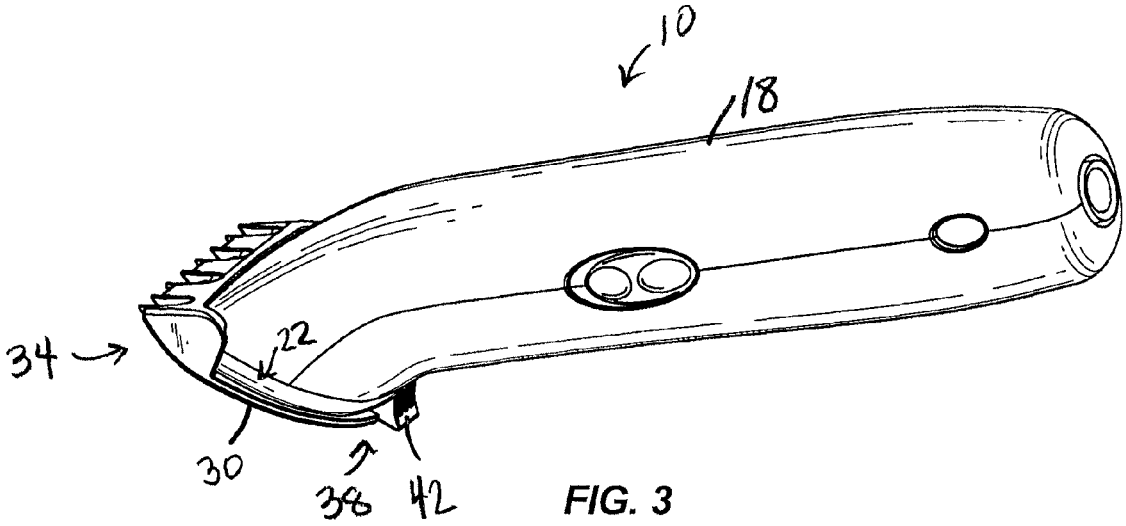
FIG. 3 is a side perspective view of the hair trimmer shown in FIG. 1.
Figure 4:
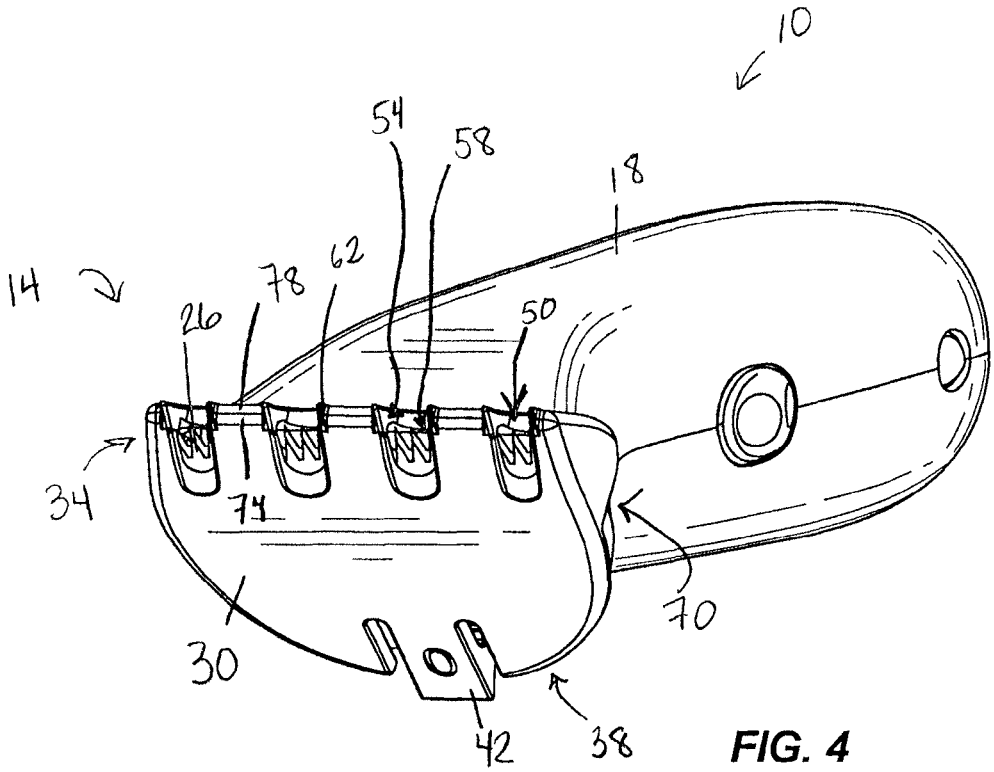
FIG. 4 is a front perspective view of the hair trimmer shown in FIG. 1.
Figure 5:
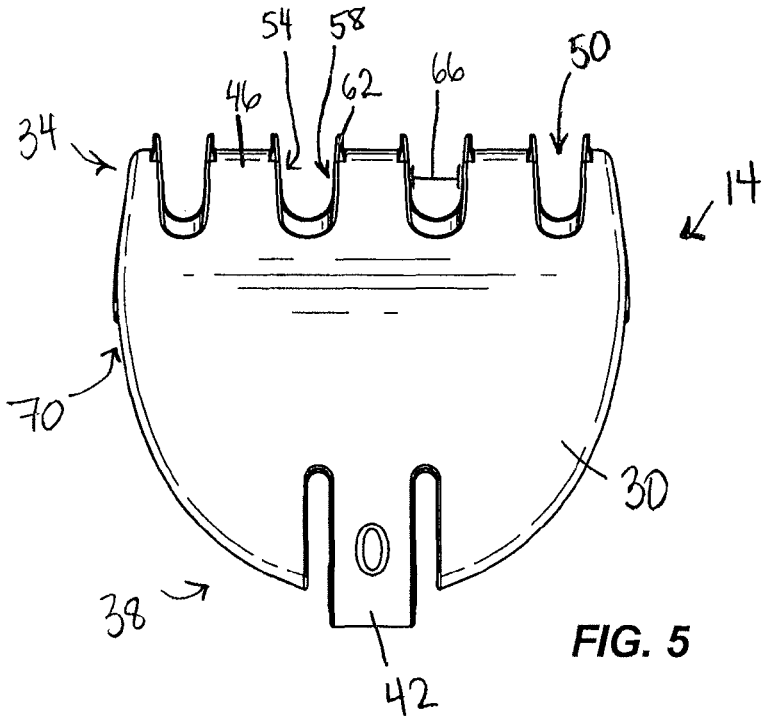
FIG. 5 is a top plan view of a comb attachment according to one embodiment of the invention.
Figure 6:
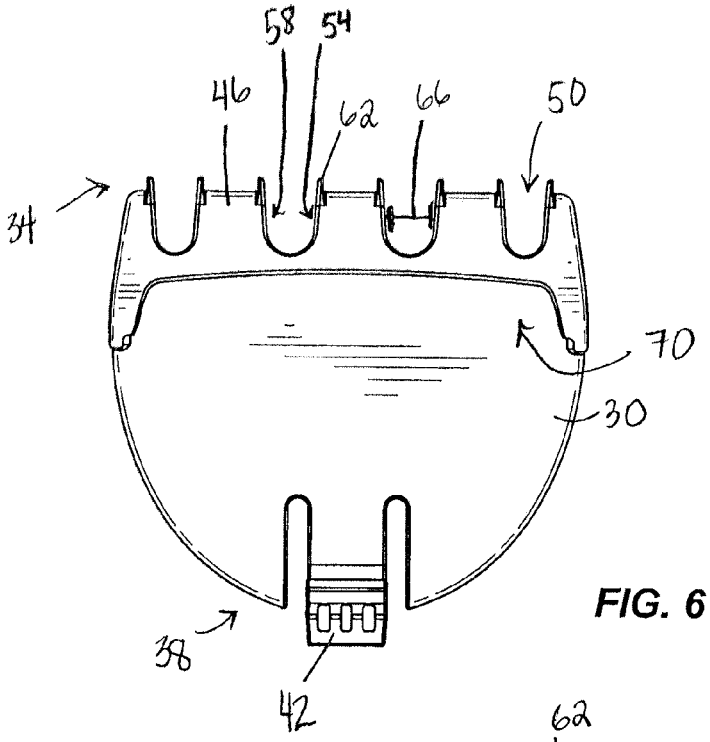
FIG. 6 is a bottom plan view of the comb attachment shown in FIG. 5.
Figure 7:
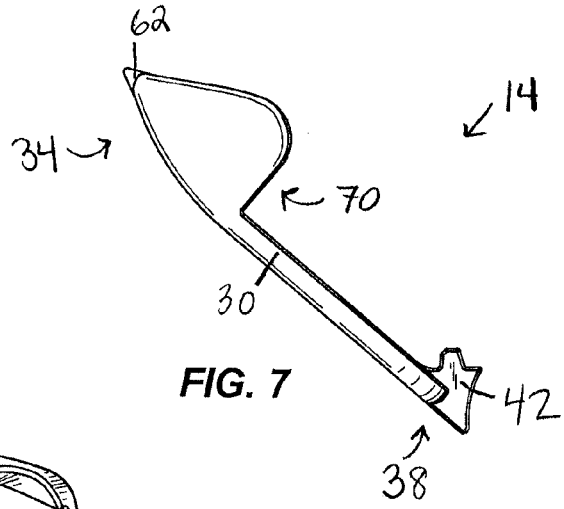
FIG. 7 is a side view of the comb attachment shown in FIG. 5.
Figure 8:
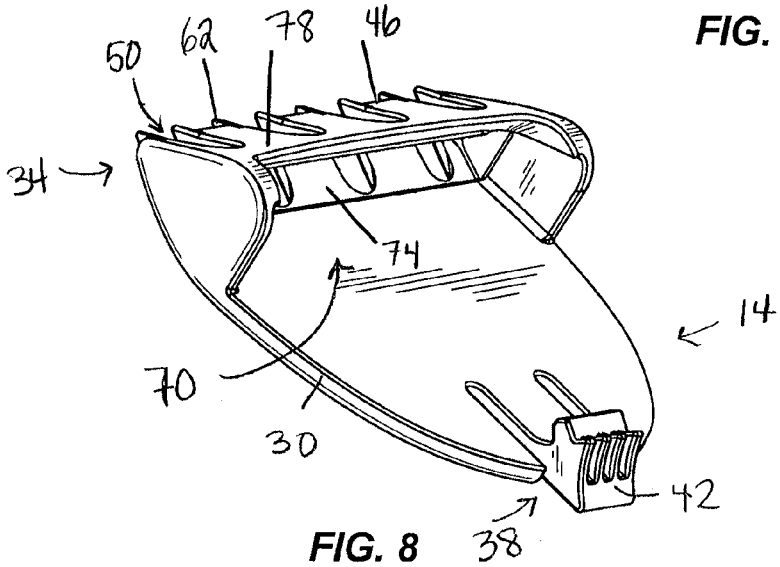
FIG. 8 is a bottom perspective view of the comb attachment shown in FIG. 5.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-4 illustrate a hair trimmer 10 and a hair comb attachment 14 according to one embodiment of the present invention, and FIGS. 5-8 further illustrate the comb attachment 14. It should be readily evident to one of ordinary skill in the art that the present invention may also be utilized with a hair clipper.

Referring to FIGS. 1-4, the comb attachment 14 is removably attachable to a hair trimmer 10. The hair trimmer 10 includes a hollow, elongated body portion 18 having a cutting end 22. The elongated body 18 supports a blade 26 on the cutting end 22. As the hair trimmer 10 is guided through a person's hair, reciprocating motion of the blade 26 cuts the person's hair. A number of suitable blades, blade sets, motors, and driving arrangements are known. It should be appreciated that hair trimmers having other types of blades, blade sets, motors, and/or driving arrangements would be suitable for use in combination with the present invention. The comb attachment 14 is used in conjunction with the hair trimmer 10 to assist a trimmer operator with the cutting and styling of hair.

The comb attachment 14 includes a comb body 30 having a leading edge 34 and a trailing edge 38, an attachment member 42, tines 46, fins 62, and a pocket 70. The leading edge 34 generally contacts the hair to be cut before the trailing edge 38 contacts the hair to be cut.

In the illustrated embodiment, the attachment member 42 is generally located at the trailing edge 38 of the comb body 30 and is configured to couple the comb attachment 14 to the hair trimmer 10 at the cutting end 22 of the hair trimmer 10. The attachment member 42 couples the comb attachment 14 to the hair trimmer 10 with a clip-on configuration. In other embodiments, the attachment member 42 couples the comb attachment 14 to the hair trimmer 10 in any number of manners, including, but not limited to, a snap-on configuration, an adhesive strip, and the like.

Tines 46 extend from the leading edge 34 of the comb body 30 whereby adjacent tines 46 define a hair guide slot 50. Each hair guide slot 50 includes a first side wall 54 and a second side wall 58. A pair of fins 62 are associated with each hair guide slot 50 such that one fin 62 is positioned proximate the first side wall 54 of the slot 50 and another fin 62 is positioned proximate the second side wall 58 of the slot 50. Each fin 62 extends outwardly from the associated tine 46. In the illustrated embodiment, the fins 62 are integrally formed with the comb body 30.

The comb attachment 14 shown in FIGS. 1-8 includes four hair guide slots 50. Each of the hair guide slots 50 has a substantially same slot width 66. In the illustrated embodiment, the slot width 66 is approximately 0.168 inches. In further embodiments, the hair guide slots 50 may have a width greater or less than 0.168 inches. Additionally, although the illustrated embodiment has four hair guide slots 50 of equal width, one of ordinary skill in the art would recognize that a comb attachment 14 could include fewer or more hair guide slots 50.

Referring to FIGS. 5-8, the leading edge 34 of the comb body 30 defines a pocket 70, or recess, for housing a cutting edge of a blade 26 of the hair trimmer 10 (as shown in FIGS. 1-4). The pocket 70 includes a first pocket side wall 74 and a second pocket side wall 78, which substantially surround the blade 26 of the hair trimmer 10. The pocket 70 is shaped such that each of the plurality of hair guide slots 50 is defined by both the first pocket side wall 74 and the second pocket side wall 78. Additionally, the fins 62 are defined by the first pocket side wall 74 and the second pocket side wall 78 (see FIGS. 4 and 8).

Figure 9:
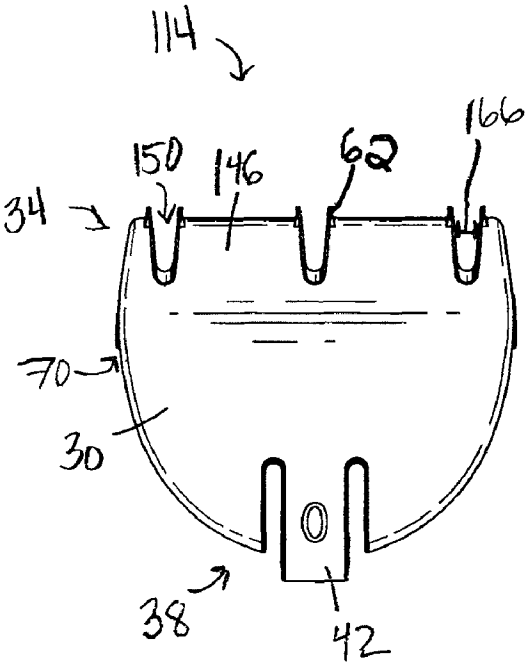
FIG. 9 is a top plan view of a comb attachment according to another embodiment of the invention.

FIG. 9 illustrates another embodiment of a comb attachment 114 according to the invention. A comb attachment 114 shown in FIG. 9 includes similar structure to the comb attachment 14 illustrated in FIGS. 1-8 described above; therefore, like structure is identified by the same reference numeral. Accordingly, with the exception of mutually inconsistent features and elements between the embodiment of FIG. 9 and the embodiments of FIGS. 1-8, reference is hereby made to the description above accompanying the embodiments of FIGS. 1-8 for a more complete description of the features and elements (and the alternatives to the features and elements) of the embodiment of FIG. 9.

Referring to FIG. 9, the comb attachment 114 includes a plurality of tines 146 that extend from the leading edge 34 of the comb body 30. The comb attachment 114 has an attachment member 42 at a trailing edge 38 to couple the comb attachment 114 to a hair trimmer 10. Adjacent tines 146 are spaced apart a slot width 166 to define a hair guide slot 150. The plurality of tines 146 generally define three hair guide slots 150 of approximately equal slot width 166. In the illustrated embodiment, the slot width 166 of hair guide slots 150 is approximately 0.111 inches. Comb attachment 114 also includes a pocket 70 defined by the leading edge 34 of the comb body 30.

Figure 10:
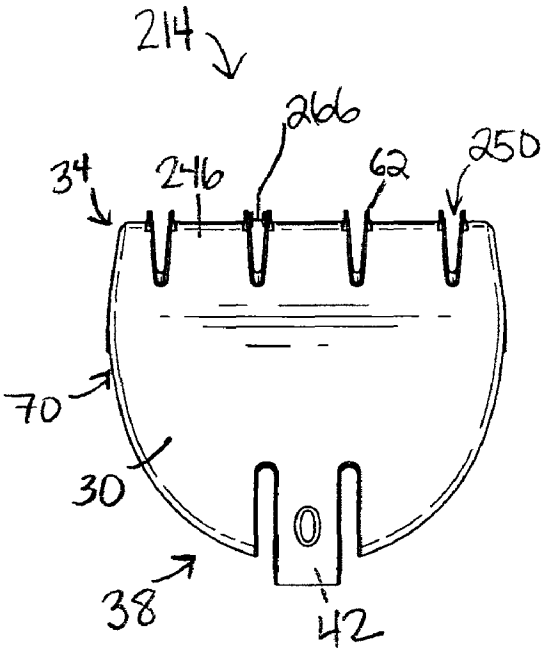
FIG. 10 is a top plan view of a comb attachment according to another embodiment of the invention.

FIG. 10 illustrates another alternate embodiment of the comb attachment 214 according to the present invention. The comb attachment 214 shown in FIG. 10 includes similar structure to the comb attachment 14 in illustrated FIGS. 1-8 described above; therefore, like structure is identified by the same reference numeral. Accordingly, with the exception of mutually inconsistent features and elements between the embodiment of FIG. 10 and the embodiments of FIGS. 1-8, reference is hereby made to the description above accompanying the embodiments of FIGS. 1-8 for a more complete description of the features and elements (and the alternatives to the features and elements) of the embodiment of FIG. 10.

Referring to FIG. 10, the comb attachment 214 includes a plurality of tines 246 that extend from the leading edge 34 of the comb body 30. The comb attachment 214 has an attachment member 42 at a trailing edge 38 to couple the comb attachment 214 to a hair trimmer 10. Adjacent tines 246 are spaced apart a slot width 266 to define a hair guide slot 250. The plurality of tines 246 generally define four hair guide slots 250 of approximately equal slot width 266. In the illustrated embodiment, the slot width 266 of hair guide slots 250 is approximately 0.066 inches. Comb attachment 214 also includes a pocket 70 defined by the leading edge 34 of the comb body 30.

Figure 11:
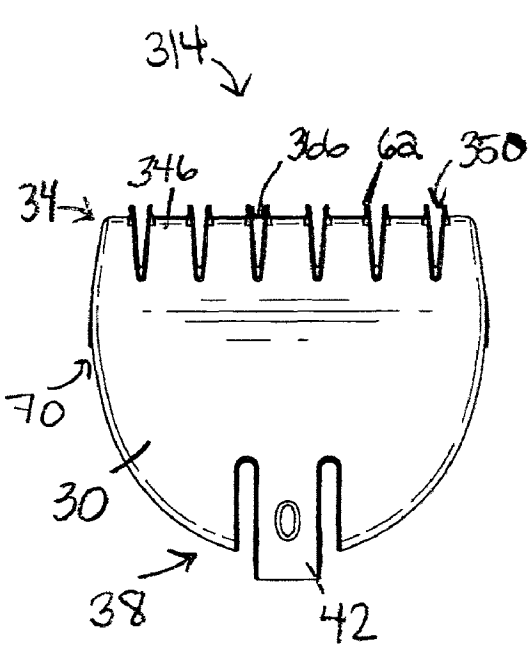
FIG. 11 is a top plan view of a comb attachment according to another embodiment of the invention.

FIG. 11 illustrates another alternate embodiment of the comb attachment 314 according to the present invention. The comb attachment 314 shown in FIG. 11 includes similar structure to the comb attachment 14 in illustrated FIGS. 1-8 described above; therefore, like structure is identified by the same reference numeral. Accordingly, with the exception of mutually inconsistent features and elements between the embodiment of FIG. 11 and the embodiments of FIGS. 1-8, reference is hereby made to the description above accompanying the embodiments of FIGS. 1-8 for a more complete description of the features and elements (and the alternatives to the features and elements) of the embodiment of FIG. 11.

Referring to FIG. 11, the comb attachment 314 includes a plurality of tines 346 that extend from the leading edge 34 of the comb body 30. The comb attachment 314 has an attachment member 42 at a trailing edge 38 to couple the comb attachment 314 to a hair trimmer 10. Adjacent tines 346 are spaced apart a slot width 366 to define a hair guide slot 350. The plurality of tines 346 generally define six hair guide slots 350 of approximately equal slot width 366. In the illustrated embodiment, the slot width 366 of hair guide slots 350 is approximately 0.058 inches. Comb attachment 314 also includes a pocket 70 defined by the leading edge 34 of the comb body 30.

Referring to the comb attachments of FIGS. 5-11, the number of hair guide slots 50 and the slot width 66 of the hair guide slots 50 varies in order to vary the amount of hair to be cut by each comb attachment 14. The slot width 66 of the hair guide slots 50 varies in order to limit the amount of hair to be cut. By way of example only, a wider hair guide slot enables more hair to be cut than a more narrow hair guide slot. Additionally, the number of hair guide slots on a comb attachment affects the amount of hair to be cut. In combination, the number of hair guide slots and the width of the hair guide slots enable an operator of a hair trimmer to create different effects in hair-cutting by use of different comb attachments.

In operation, the tines 46, hair guide slots 50 and fins 62 control the amount of hair passing through the comb attachment 14 and reaching the blade 26 for cutting. In addition, the fins 62 further retain hair and prevent hair from falling into the hair guide slot 50 where the hair reaches the blade 26 to be cut. As the comb attachment 14 is moved through hair, the comb attachment 14 gathers hair in the hair guide slots 50 to be cut by the hair trimmer 10. The fins 62 help prevent excess hair from entering the hair guide slots 50 once the hair guide slots 50 become full of hair to be cut. The fins 62 further help to retain captured hair within the hair guide slots 50. The combination of the hair guide slots 50 and fins 62 also allow an operator to create various styling and cutting effects.

Figure 12:
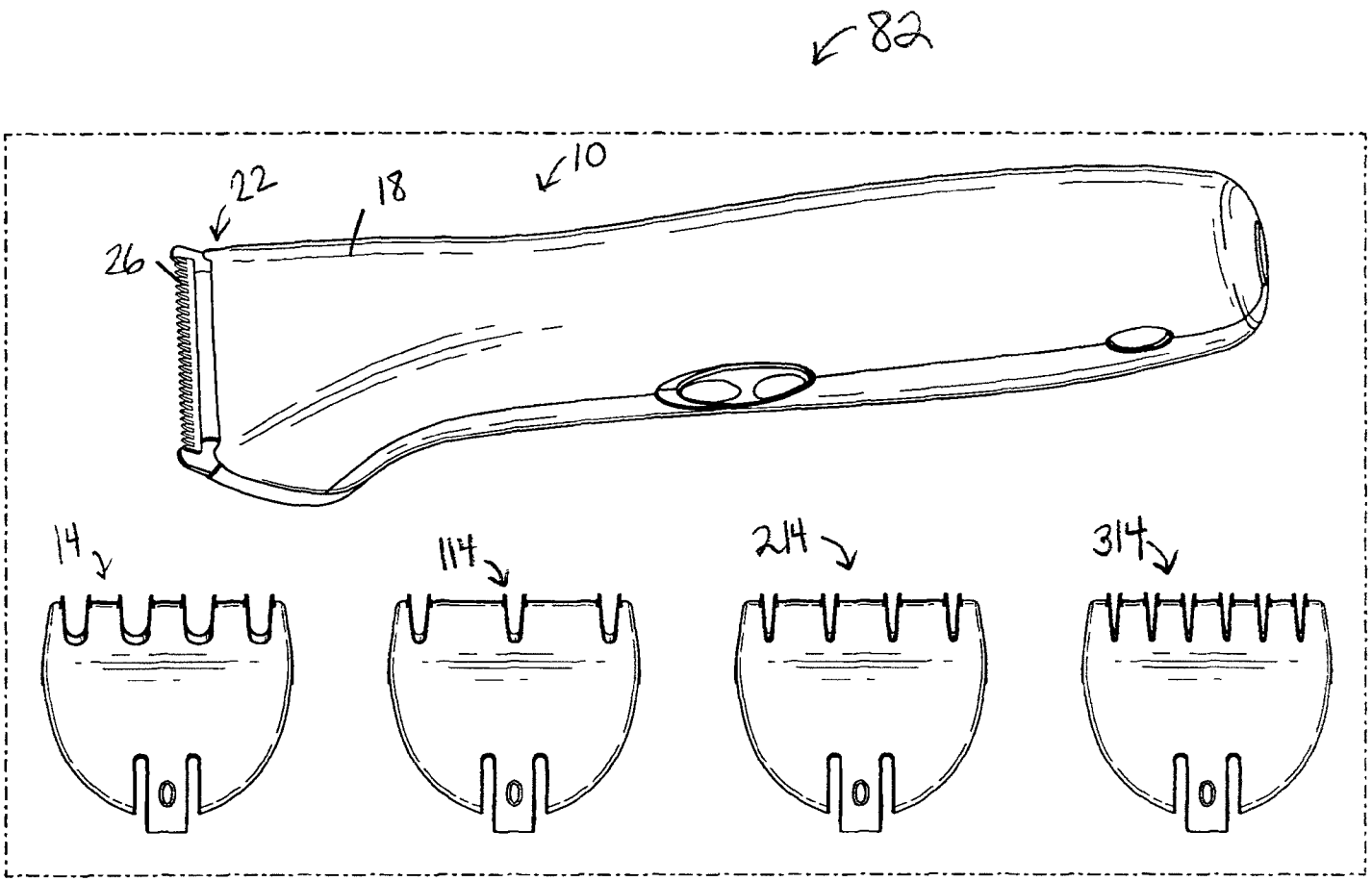
FIG. 12 is a schematic diagram of a hair cutting system according to one embodiment of the invention.

FIG. 12 illustrates one embodiment of a hair cutting system 82 utilizing the comb attachments described above. The hair cutting system 82 includes a hair trimmer 10 and any number of comb attachments 14, 114, 214, 314, each of the comb attachments 14, 114, 214, 314 configured to be removably attached to the hair trimmer 10. In other embodiments, the system includes a hair trimmer 10 and any combination of the comb attachments 14, 114, 214, 314. In still other embodiments, the system includes a hair clipper and fewer or more comb attachments. It should be readily apparent to those of skill in the art that any combination of comb attachments may be packaged with the hair cutting system 82. For example, the comb attachments 14, 114, 214, 314 described above may be used, or other comb attachments incorporating the features described above may be used. The system is packaged to provide an operator a variety of comb attachments to utilize in order to create a variety of hair styling effects and techniques.

The hair cutting system 82 includes any combination of comb attachments 14, 114, 214, 314 for use with a hair trimmer or a hair clipper. Additionally, one of ordinary skill in the art will recognize that the present invention may further embody a number of hair guide slots and/or variety of slot widths not illustrated in the illustrated embodiments. Therefore, the present invention is not limited to the embodiments of the comb attachments as shown, but can further include more or less of a plurality of hair guide slots than shown and a plurality of lesser or greater slot widths than shown in the illustrated embodiments.

Other embodiments of the present invention may utilize combinations of the above embodiments. The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the claims.

What is claimed is:

1. A comb attachment for a hair trimmer, the comb attachment comprising:

a comb body including a first wall with a trailing edge having thereon an attachment member for attaching the comb body to the hair trimmer, and the comb body having a leading edge positioned opposite the trailing edge, a direction from the trailing edge toward the leading edge defining a forward direction;

a hair guide slot defined in the leading edge between first and second tines, each tine having a free edge that defines a portion of the leading edge of the comb body, the free edge configured to contact hair to be cut during operation of the trimmer; and first and second fins associated with the hair guide slot, wherein the first fin is positioned on the first tine and the second fin is positioned on the second tine, and wherein each of the fins extends beyond the free edge of the associated tine;

wherein the fins extend in the forward direction beyond the leading edge; and wherein the free edge defining a portion of the leading edge of the comb body is a straight edge.

2. A comb attachment for a hair trimmer, the comb attachment comprising:

a comb body including a first wall with a trailing edge having thereon an attachment member for attaching the comb body to the hair trimmer, and the comb body having a leading edge positioned opposite the trailing edge, a direction from the trailing edge toward the leading edge defining a forward direction;

a hair guide slot defined in the leading edge between first and second tines, each tine having a free edge that defines a portion of the leading edge of the comb body, the free edge configured to contact hair to be cut during operation of the trimmer; and first and second fins associated with the hair guide slot, wherein the first fin is positioned on the first tine and the second fin is positioned on the second tine, and wherein each of the fins extends beyond the free edge of the associated tine;

wherein the fins extend in the forward direction beyond the leading edge; and wherein each of the fins is generally triangular.

3. The comb attachment as set forth in claim 2, wherein each of the fins is generally planar and extends perpendicularly from the leading edge.

4. The comb attachment as set forth in claim 2, and further comprising a plurality of hair guide slots, wherein each hair guide slot is defined between first and second adjacent tines and includes first and second fins associated therewith, the first and second fins respectively positioned on the first and second adjacent tines, and wherein each of the fins extends beyond the free edge of the associated tine.

5. A comb attachment for a hair trimmer, the comb attachment comprising:

a comb body including a first wall with a trailing edge having thereon an attachment member for attaching the comb body to the hair trimmer, and the comb body having a leading edge positioned opposite the trailing edge, a direction from the trailing edge toward the leading edge defining a forward direction;

a hair guide slot defined in the leading edge between first and second tines, each tine having a free edge that defines a portion of the leading edge of the comb body, the free edge configured to contact hair to be cut during operation of the trimmer; and first and second fins associated with the hair guide slot, wherein the first fin is positioned on the first tine and the second fin is positioned on the second tine, and wherein each of the fins extends beyond the free edge of the associated tine;

wherein the fins extend in the forward direction beyond the leading edge;

wherein the hair guide slot has opposite first and second sides respectively adjacent the first and second tines, wherein the first fin is adjacent the first side of the hair guide slot, and wherein the second fin is adjacent the second side of the hair guide slot; and wherein the comb body includes a second wall, the second wall intersecting the first wall at the leading edge.

6. The comb attachment as set forth in claim 5, wherein the first and second walls define a pocket for housing a cutting edge of a blade of the hair trimmer.

7. The comb attachment as set forth in claim 5, wherein each of the fins comprises a smooth extension of the first and second walls of the comb body beyond the leading edge.

8. The comb attachment as set forth in claim 5, wherein each of the fins comprises a surface transverse to first and second walls.

9. A comb attachment for a hair trimmer, the comb attachment comprising:

a comb body including a first wall extending from a leading edge to a trailing edge, the trailing edge having thereon an attachment member for attaching the comb body to the hair trimmer, a direction from the trailing edge toward the leading edge defining a forward direction;

the comb body including first and second hair guide slots extending from the leading edge toward the trailing edge, the hair guide slots defining a tine therebetween, the tine having a free edge that defines at least a portion of the leading edge of the comb body, and the tine having opposite first and second lateral edges respectively partially defining the first and second hair guide slots; and first and second fins respectively disposed at the first and second lateral edges of the tine, the first fin positioned adjacent the first hair guide slot, and the second fin positioned adjacent the second hair guide slot, wherein the first and second fins extend from the free edge of the tine and beyond the leading edge of the comb body;

wherein the fins extend in the forward direction beyond the leading edge; and wherein the comb body includes a second wall, the second wall intersecting the first wall at the leading edge.

10. The comb attachment as set forth in claim 9, wherein the first and second walls define a pocket for housing a cutting edge of a blade of the hair trimmer.

11. The comb attachment as set forth in claim 9, wherein each of the fins comprises a smooth extension of the first and second walls of the comb body beyond the leading edge.

12. The comb attachment as set forth in claim 9, wherein each of the fins comprises a surface transverse to the first and second walls of the comb body.

13. A comb attachment for a hair trimmer, the comb attachment comprising:

a comb body including a first wall extending from a leading edge to a trailing edge, the trailing edge having thereon an attachment member for attaching the comb body to the hair trimmer, a direction from the trailing edge toward the leading edge defining a forward direction;

the comb body including first and second hair guide slots extending from the leading edge toward the trailing edge, the hair guide slots defining a tine therebetween, the tine having a free edge that defines at least a portion of the leading edge of the comb body, and the tine having opposite first and second lateral edges respectively partially defining the first and second hair guide slots; and first and second fins respectively disposed at the first and second lateral edges of the tine, the first fin positioned adjacent the first hair guide slot, and the second fin positioned adjacent the second hair guide slot, wherein the first and second fins extend from the free edge of the tine and beyond the leading edge of the comb body;

wherein the fins extend in the forward direction beyond the leading edge; and wherein each of the fins is generally triangular.

14. The comb attachment as set forth in claim 13, wherein each of the fins is generally planar and extends perpendicularly from the leading edge.

15. The comb attachment as set forth in claim 13, wherein the first and second hair guide slots have substantially the same width.

16. The comb attachment as set forth in claim 13, and further comprising a recess formed between the first and second fins at the free edge of the tine.

17. The comb attachment as set forth in claim 13, and further comprising a plurality of tines, each tine having first and second fins respectively disposed at the first and second lateral edges thereof, and wherein each of the fins extends beyond the free edge of the associated tine.

* * * * *